US011259634B1

(12) United States Patent
Chen

(10) Patent No.: US 11,259,634 B1
(45) Date of Patent: Mar. 1, 2022

(54) FOLDABLE DRAWER STORAGE DEVICE

(71) Applicant: PROTREND CO., LTD., Taipei (TW)

(72) Inventor: Henry Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 17/229,896

(22) Filed: Apr. 14, 2021

(51) Int. Cl.
*A47B 88/90* (2017.01)
*A47B 88/40* (2017.01)
*A47B 43/00* (2006.01)

(52) U.S. Cl.
CPC ..... *A47B 88/9414* (2017.01); *A47B 43/00* (2013.01); *A47B 88/402* (2017.01)

(58) Field of Classification Search
CPC . A47B 88/402; A47B 88/0455; A47B 88/941; A47B 88/0014; A47B 88/9412; A47B 88/0018; A47B 88/9414; A47B 88/0022; A47B 88/9416; A47B 88/0025; A47B 88/9418; A47B 88/0029; A47B 43/00; A47B 2210/09
See application file for complete search history.

(56) References Cited

U.S. PATENT DOCUMENTS 1,822,448 A * 9/1931 Morin ..... A47B 88/9412 312/258
4,936,641 A * 6/1990 Bussan ..... F25D 25/02 211/134
6,619,769 B1 * 9/2003 Hammonds ..... A47B 88/90 312/330.1
7,549,550 B2 * 6/2009 Smyers ..... B65D 11/1833 220/6
9,095,212 B2 * 8/2015 Yamamoto ..... A47B 87/0276
2007/0051720 A1 * 3/2007 Chen ..... B65D 11/1846 220/6
2009/0145897 A1 * 6/2009 Chen ..... B65D 11/1826 220/4.28
2011/0221318 A1 * 9/2011 Chen ..... A47B 88/941 312/263
2018/0192772 A1 * 7/2018 Yamamoto ..... A47B 88/941

FOREIGN PATENT DOCUMENTS

FR 845105 A * 8/1939 ..... A47B 88/483
FR 2652135 A1 * 3/1991 ..... A47B 43/00
GB 224089 A * 11/1924 ..... A47B 88/402
WO WO-2009046570 A1 * 4/2009 ..... A47B 88/9412
WO WO-2016023189 A1 * 2/2016 ..... A47B 88/402

* cited by examiner

*Primary Examiner* — Andrew M Roersma
(74) *Attorney, Agent, or Firm* — WPAT, PC

(57) ABSTRACT

A foldable drawer storage device consisting of: one drawer and one shell. The drawer can be folded flat or expanded into a box shape. The shell can be folded flat or expanded into standing position. Folded flat, the drawer and the shell take up small space and are easy to store. When the drawer and the shell are both expanded, the shell becomes the exterior box of the drawer, which allows the drawer to be pushed into the shell. The drawer can also be pulled out, revealing the entire storage space of the drawer.

3 Claims, 15 Drawing Sheets

FOLDABLE DRAWER STORAGE DEVICE

FIELD OF INVENTION

This invention discloses a foldable drawer storage device which can be folded flat for convenient storage and lower transportation costs.

PRIOR ART

A plastic drawer storage device commonly seen on the market mainly consist of a frame and a drawer. The drawer can be installed on the frame and is exposed by pulling outwards and stored by pushing inwards. The frame is usually a one-piece design and large in size. The drawer is also in one-piece design. Despite its lightweight, the plastic drawer is often too large in size, taking up too much space, which adds difficulties to storage as well as transportation costs.

There is also another type consisting of a single shell and a drawer on the market. The shell is made one-piece and has only one opening. The drawer is also in one-piece design. The drawer is pushed into the shell to form a storage device with one drawer. Even this type of storage device inevitably takes up too much space.

SUMMARY OF THE INVENTION

In order to solve such size-related problem, this invention discloses a foldable drawer storage device which can fold flat to significantly reduce the space taken up when in storage, which helps with storage and lower transportation costs.

The foldable drawer storage device disclosed in this invention consists of: one drawer and one shell. The drawer consists of: one bottom panel, one front panel, one rear panel, one left panel, and one right panel. The lower ends of the front, rear, left and right panels are pin-connected to the front, rear, left and right ends of the bottom panel, and can rotate to upright or lying position. The shell consists of: one top panel, one left outer panel, and one right outer panel. The top ends of the left and right outer panels are each pin-connected to the left and right ends of the top panel. The left outer panel and the right outer panel can then rotate to upright or lying position. The two outer walls of the bottom panel each has a protruding bar with the back sides facing each other. There is a guiding groove on each of the insides of the left and right outer panels of the shell. The grooves face each other. By inserting the two protruding bars on the outer walls of the bottom panel of the drawer into the two guiding grooves of the insides of the left and right outer panels of the shell, the drawer can be pushed into the shell.

Each of the two sides of the top panel of the shell has a downward-facing protruding wall. The inner walls of the two protruding walls each has at least one co-axial pivot. The top ends of the left and right outer panels each has at least one C-shaped hook corresponding to each pivot. By hooking the C-shaped hooks of the left and right outer panels onto the corresponding pivots of the top panel, the left and right outer panels can rotate to upright or lying position. The bottom ends of the two protruding walls of the top panel each has at least one downward-facing protruding hook; the top ends of the left and right outer panels each has as least one hole to allow the protruding hooks of the two protruding walls to pass through. This holds the left and right outer panels to be locked in upright position.

The two edges of the top side of the top panel of the shell each has two protruding points. The bottom sides of the left and right outer panels each has two positioning holes. The positioning holes and the protruding points correspond to one another in a top-bottom manner.

Four sides of the bottom panel of the drawer each has a upward-facing protruding wall. The inner walls of the protruding walls each has at least one co-axial pivot. Corresponding to the pivots of the protruding walls, the bottom ends of the front, rear, left and right panels each has at least one C-shaped hook. By hooking the C-shaped hooks of the front, rear, left and right panels onto the pivots of the bottom panel, the front, rear, left and right panels can rotate to upright or lying position. The top ends of the left and right protruding walls of the bottom panel each has at least one upward-facing protruding hook. The bottom ends of the left and right panels each has at least one hole for the protruding hooks of the left and right protruding walls of the bottom panel to pass through. This allows the left and right panels to be locked into upright position.

The front and rear ends of the left and right panels of the drawer each has one inward-facing L-shaped hook. When the front panel is in upright position, the L-shaped hooks at the front ends of the left and right panels can stop at the front end of the front wall. When the rear panel is in upright position, the L-shaped hooks at the rear ends of the left and right panels can stop at the rear end of the rear panel. The insides of the L-shaped hooks on the front and rear ends of the left and right panels each has one horizontally extending, double-slope inner stopping block. The inner stopping blocks can each stop the insides of the front and rear panels.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DESCRIPTION OF PREFERRED EMBODIMENT

Figure 1:
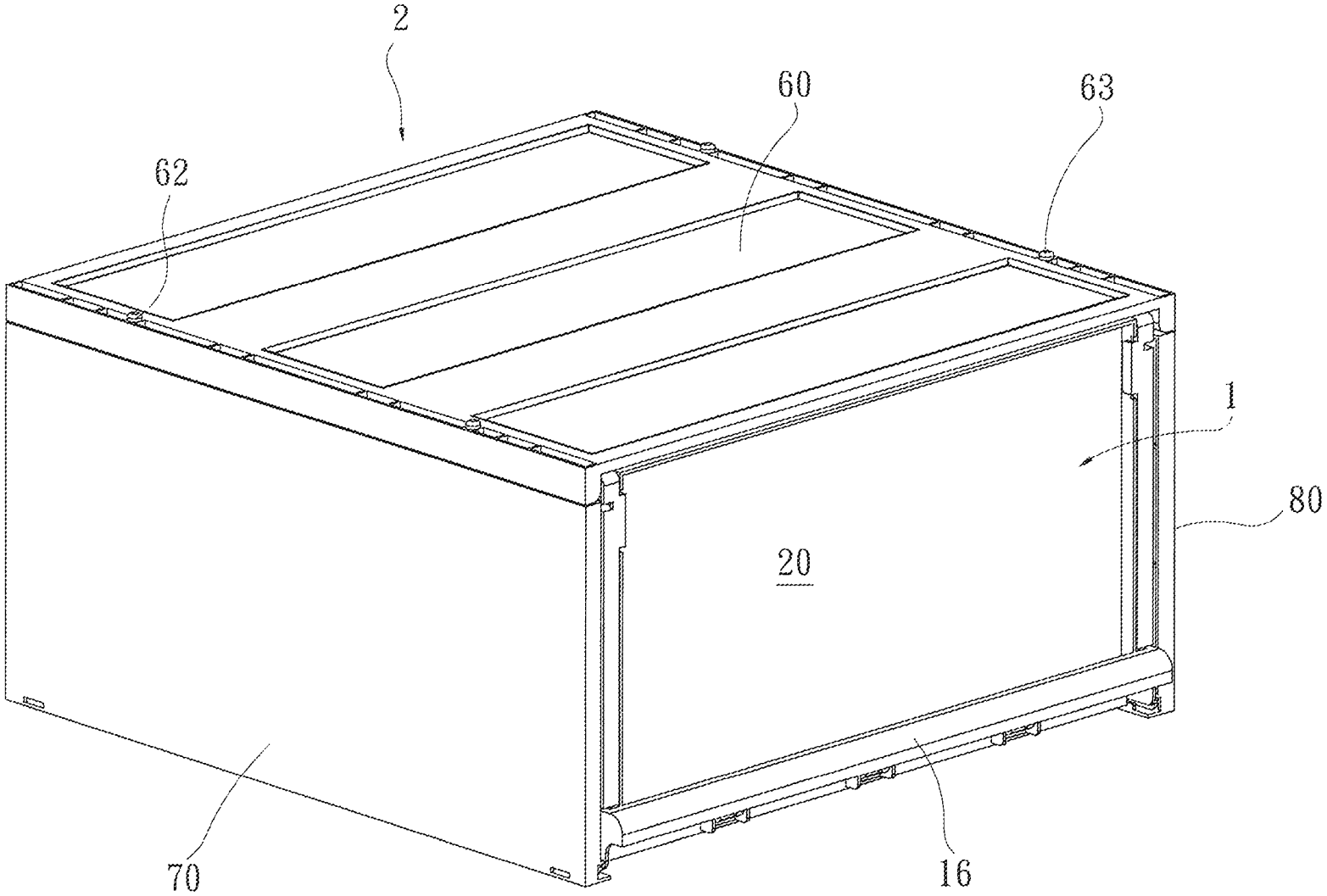
FIG. 1 is the exterior drawing of an embodiment of this invention.
Figure 2:
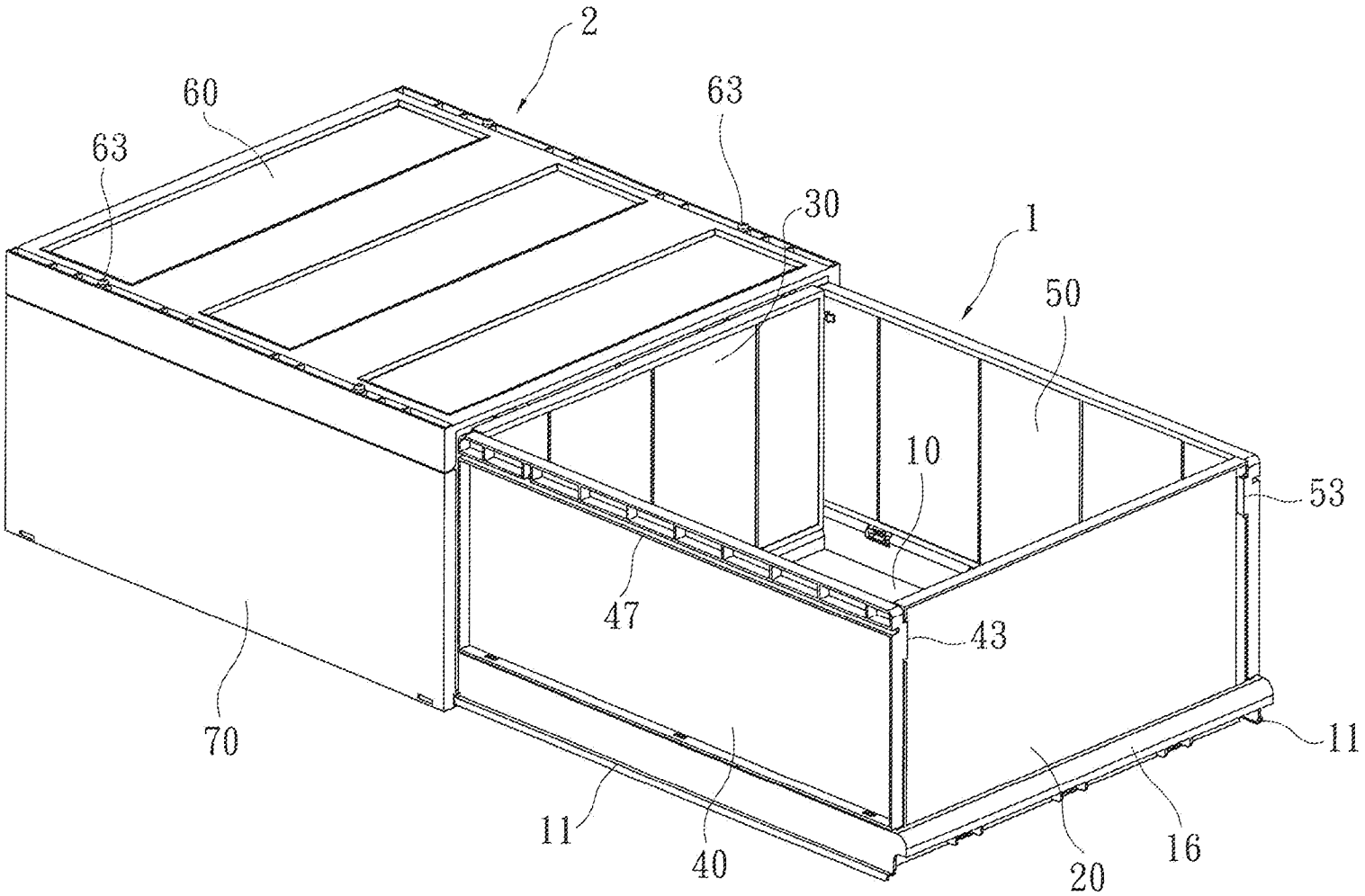
FIG. 2 demonstrates the drawer being pulled out halfway.
Figure 3:
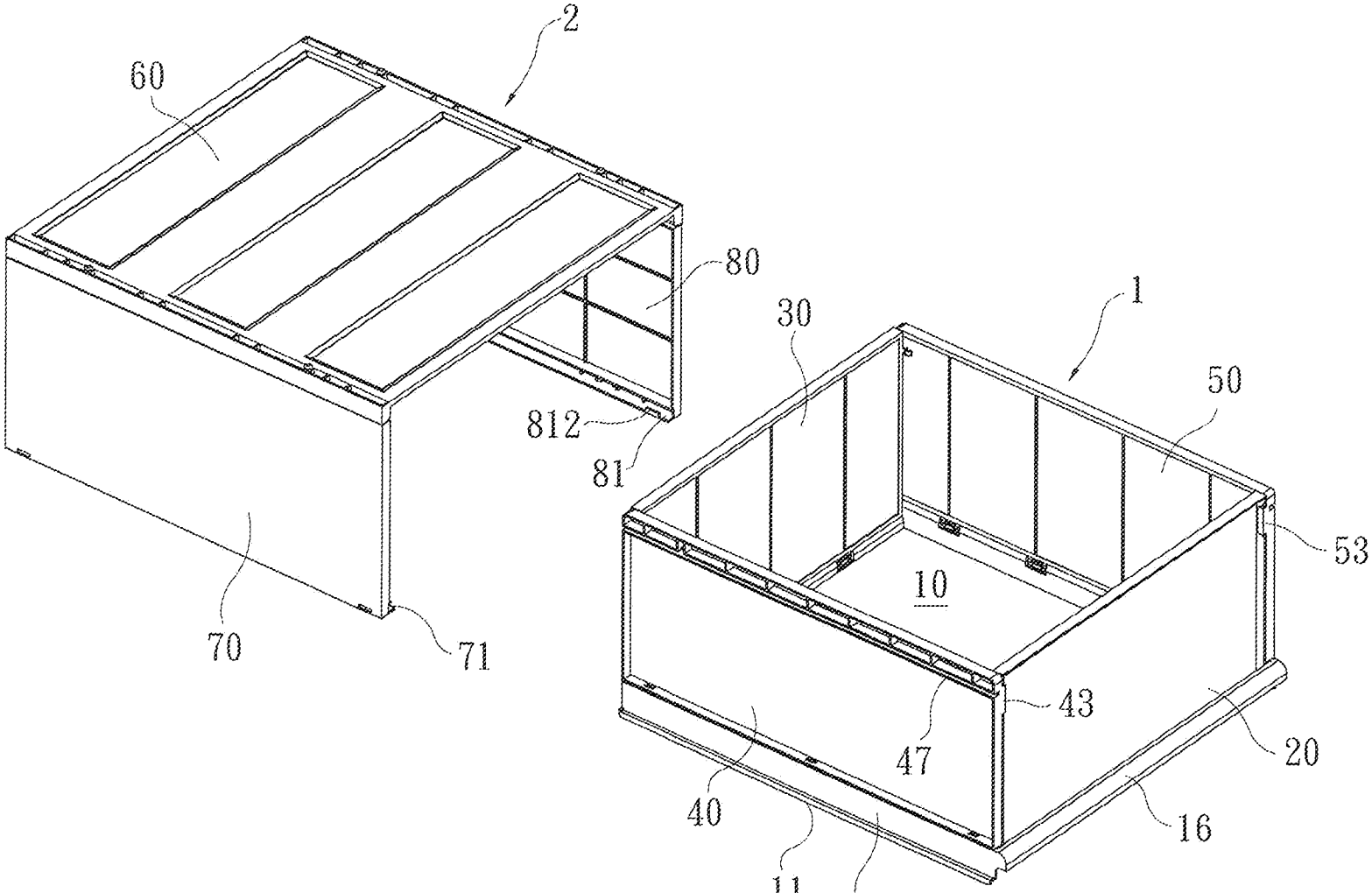
FIG. 3 demonstrates the drawer being completely pulled out.

See FIGS. 1 to 3. The foldable drawer storage device disclosed in this invention consists of: one drawer 1 and one shell 2. The drawer 1 can be folded flat or expanded into a box shape. The shell 2 can be folded flat or expanded into standing position. Folded flat, the drawer 1 and the shell 2 take up small space and are easy to store. When the drawer 1 and the shell 2 are both expanded, the shell 2 becomes the exterior box of the drawer 1, which allows the drawer 1 to be pushed into the shell 2. The drawer 1 can also be pulled out, revealing the entire storage space of the drawer 1.

Figure 4:
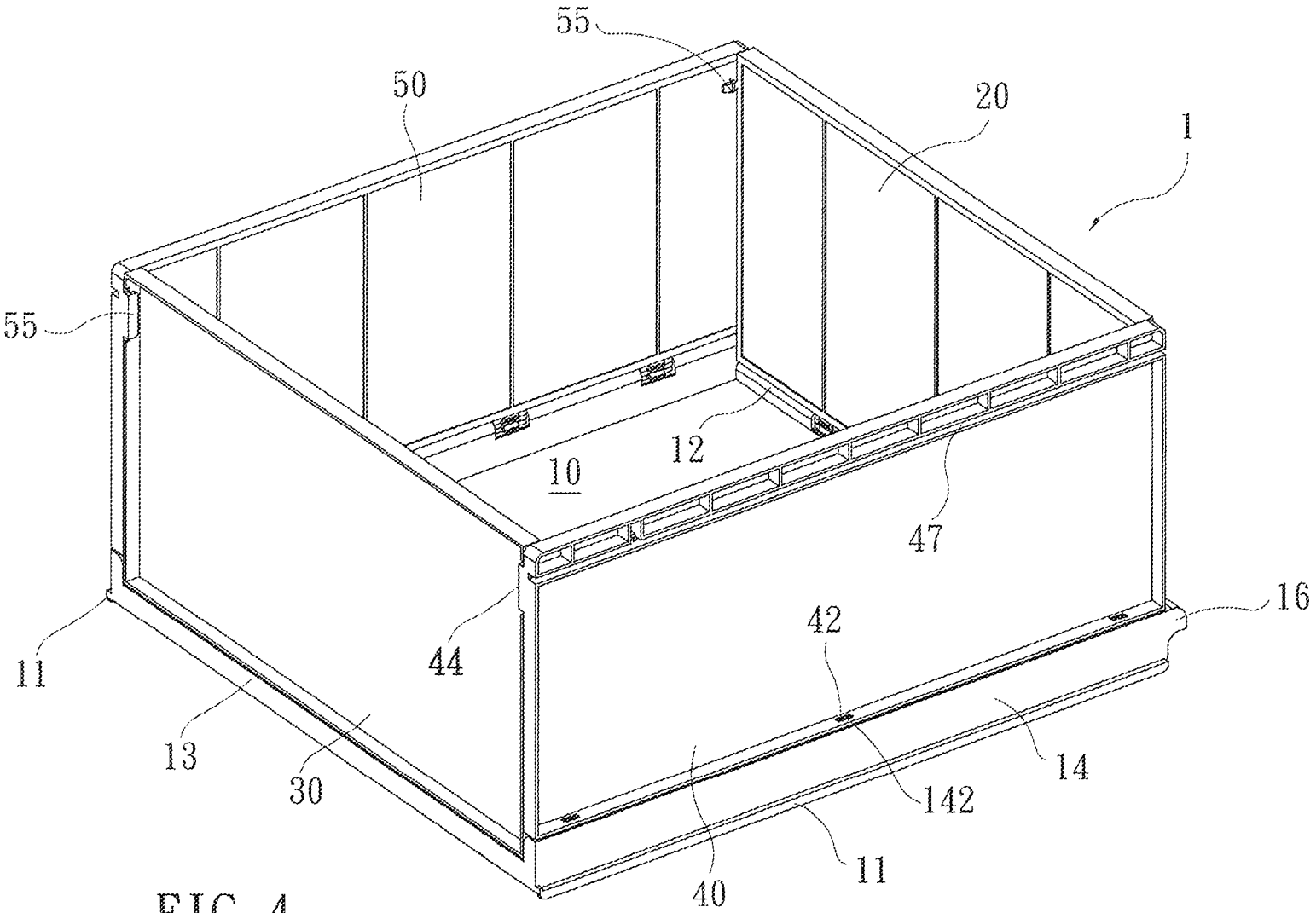
FIG. 4 is an exterior drawing of the drawer.
Figure 5:
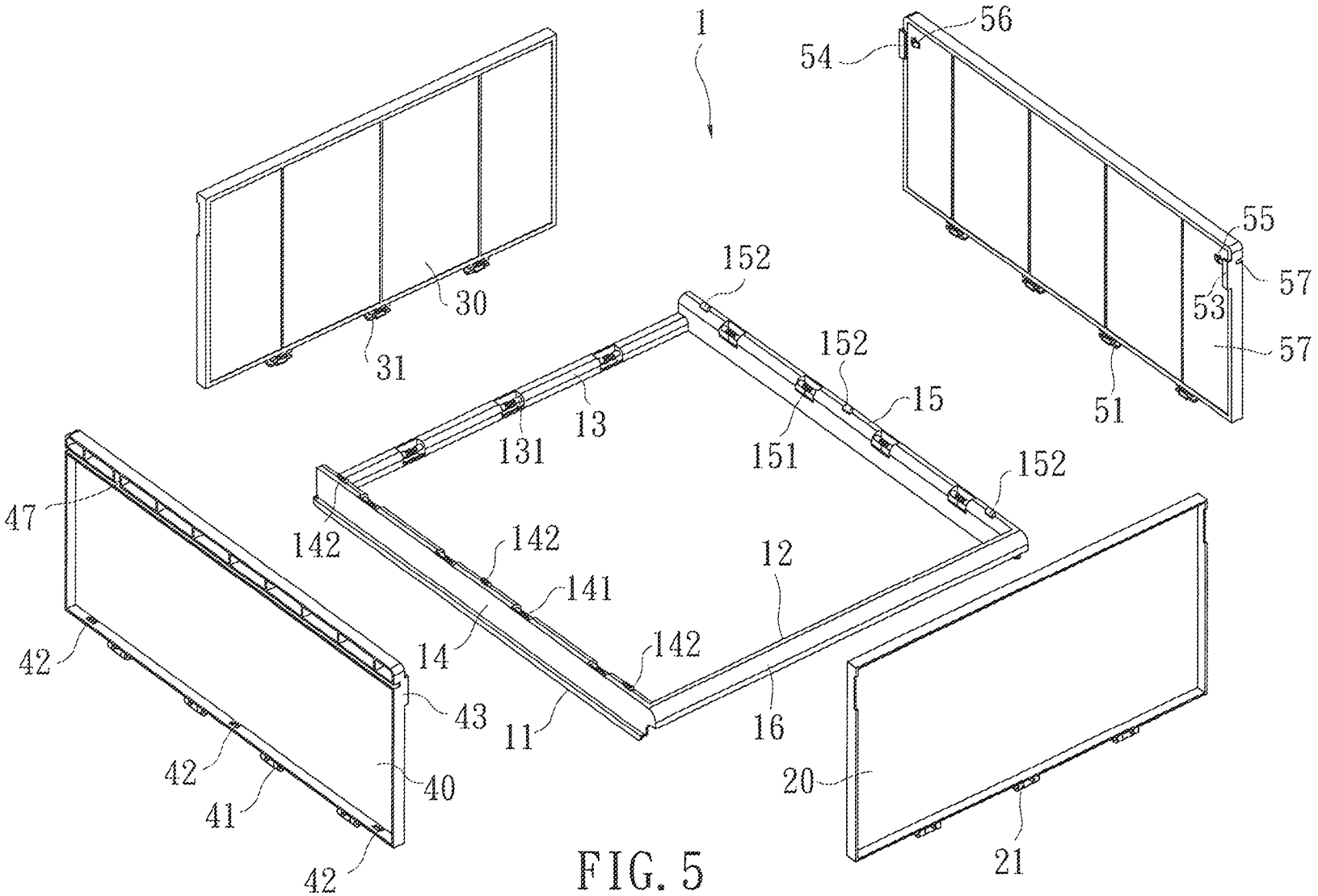
FIG. 5 is a breakdown drawing of the drawer.
Figure 6:
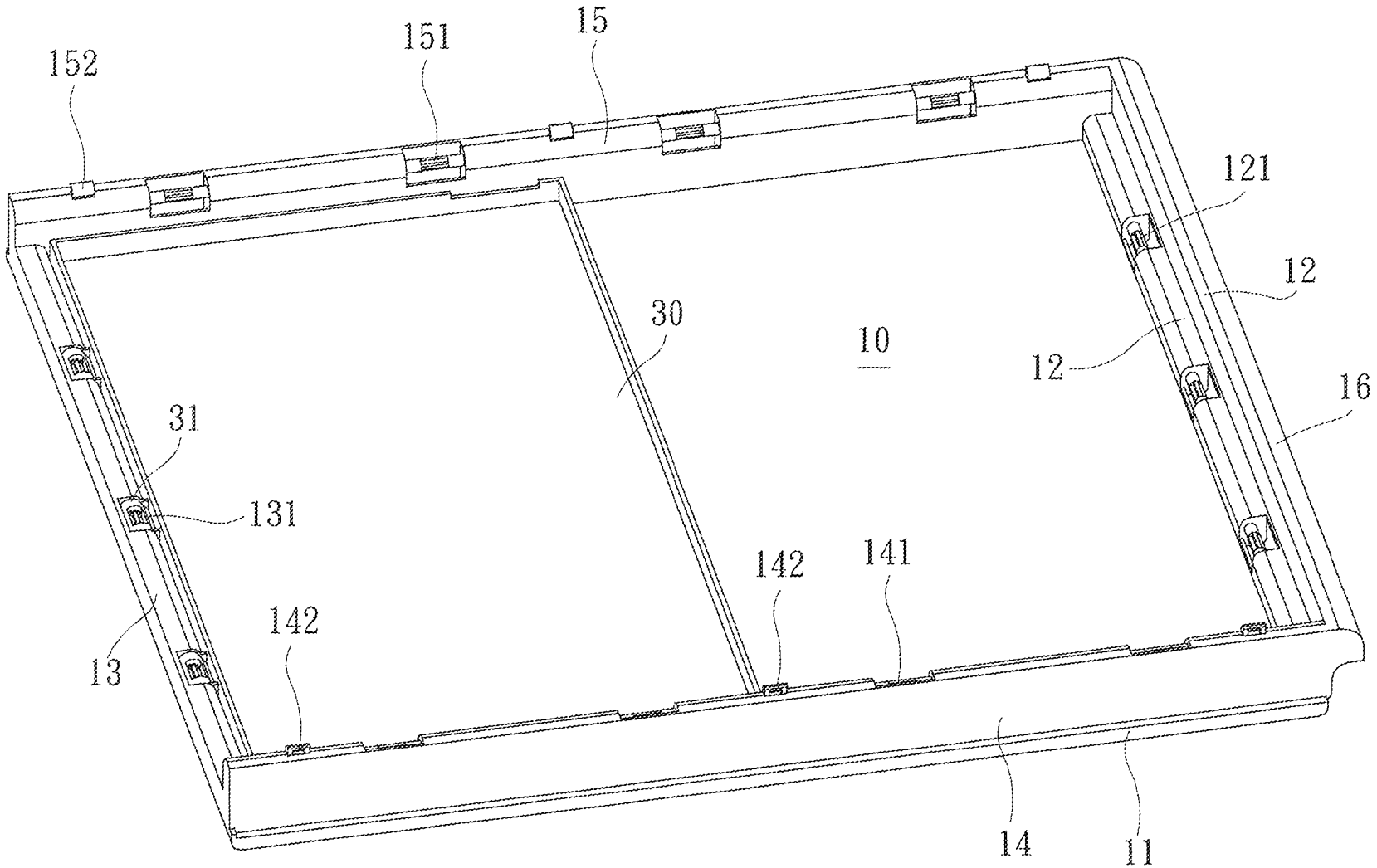
FIG. 6 is a drawing of the rear panel of the drawer when it is fully assembled.

See FIGS. 4 and 5. The drawer 1 consists of: one bottom panel 10, one front panel 20, one rear panel 30, one left panel 40, and one right panel 50. The lower ends of the front 20, rear 30, left 40 and right 50 panels are pin-connected to the front, rear, left and right ends of the bottom panel 10. The front 20, rear 30, left 40, right 50 panels can each rotate to upright or lying position with the pin connections as axes. The two outer walls of the bottom panel 10 each has a protruding bar 11 with the back sides facing each other. The two protruding bars 11 each extends in a front-to-back manner. The left and right panels 40, 50 are identical components, and are placed symmetrically. The front and rear panels 20, 30 are identical components, and are placed symmetrically.

Four sides of the bottom panel 10 of the drawer 1 each has an upward-facing protruding wall 12, 13, 14, 15. The inner walls of the protruding walls 12, 13, 14, 15 each has at least one co-axial pivot 121, 131, 141, 151. Corresponding to the pivots 121, 131, 141, 151 of the protruding walls 12, 13, 14, 15 of the bottom ends of the front 20, rear 30, left 40 and right 50 panels each has at least one C-shaped hook 21, 31, 41, 51. By hooking the C-shaped hooks 21, 31, 41, 51 of the front 20, rear 30, left 40 and right 50 panels onto the pivots 121, 131, 141, 151 of the bottom panel 10, the front 20, rear 30, left 40 and right 50 panels can rotate to upright or lying position with the pivots 121, 131, 141, 151 as axes. In this embodiment, the protruding walls 12, 13 on the front and rear ends of the bottom panel 10 each has three pivots 121, 131. The front and rear panels 20, 30 each has three C-shaped hooks 21, 31. There are four pivots 141, 151 on the protruding walls 14, 15 of the left and right ends of the bottom panel 10. The left and right panels 40, 50 each has four C-shaped hooks 41, 51. There is a handle 16 extending out of the protruding wall 12 of the bottom panel. The handle 16 allows the user to move the drawer 1 conveniently.

The top ends of the left and right protruding walls 14, 15 of the bottom panel 10 of the drawer 1 each has at least one upward-facing protruding hook 142, 152. The bottom ends of the left and right panels 40, 50 each has at least one hole 42, 52 (see FIG. 7) for the protruding hooks 142, 152 of the left and right protruding walls 14, 15 of the bottom panel 10 to pass through. This allows the left and right panels 40, 50 to be locked into upright position. The inside of each protruding hooks 142, 152 are in a curved shape, which allows the bottom ends of the left and right panels 40, 50 to cross the insides of the protruding hooks 142, 152. To fold the left and right panels, one only has to forcefully push the left and right panels inwards, allowing the holes 42, 52 on the left and right panels 40, 50 to detach from the protruding hooks 142, 152.

Figure 7:
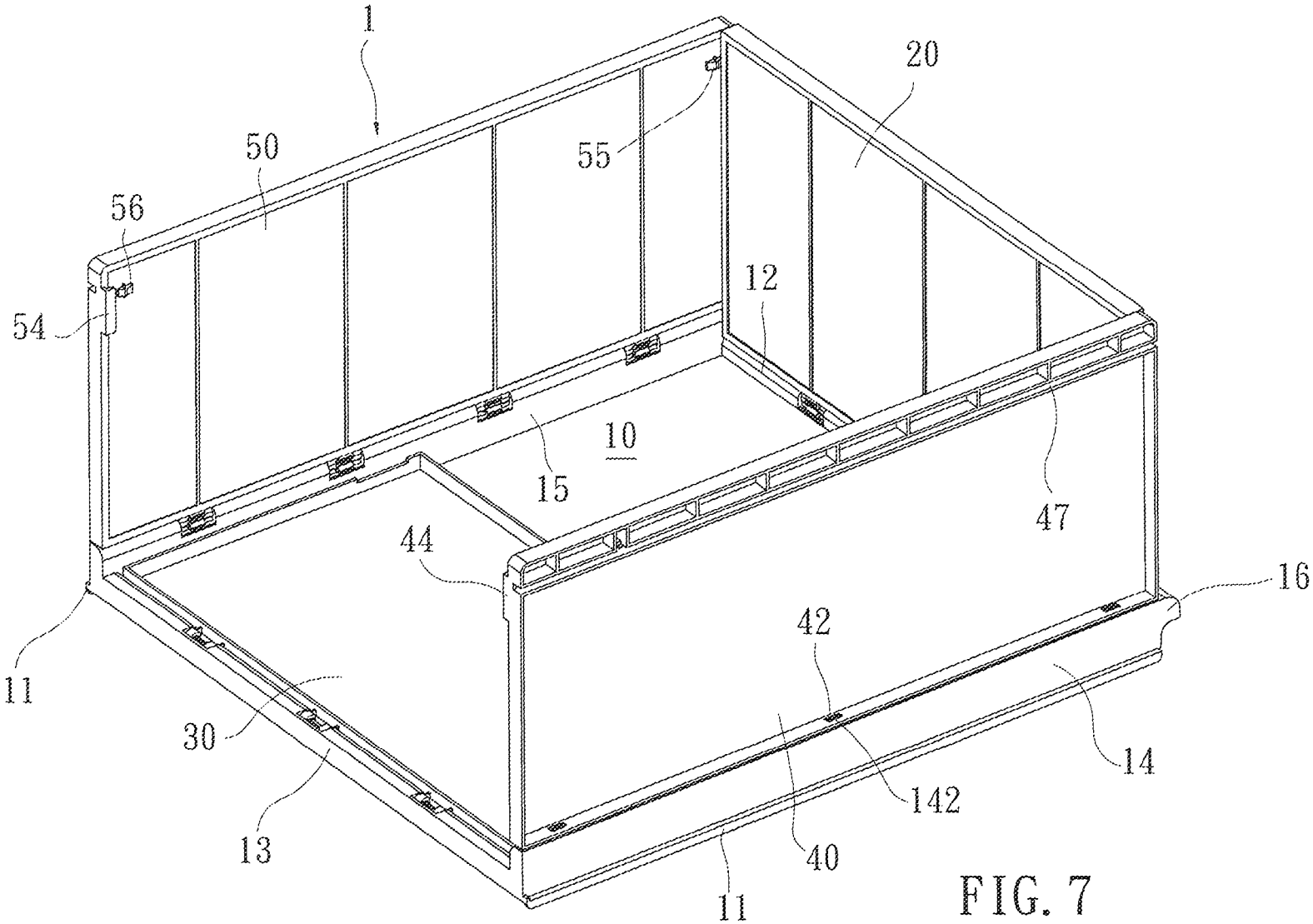
FIGS. 7 to 9 demonstrates the drawer being folded.
Figure 8:
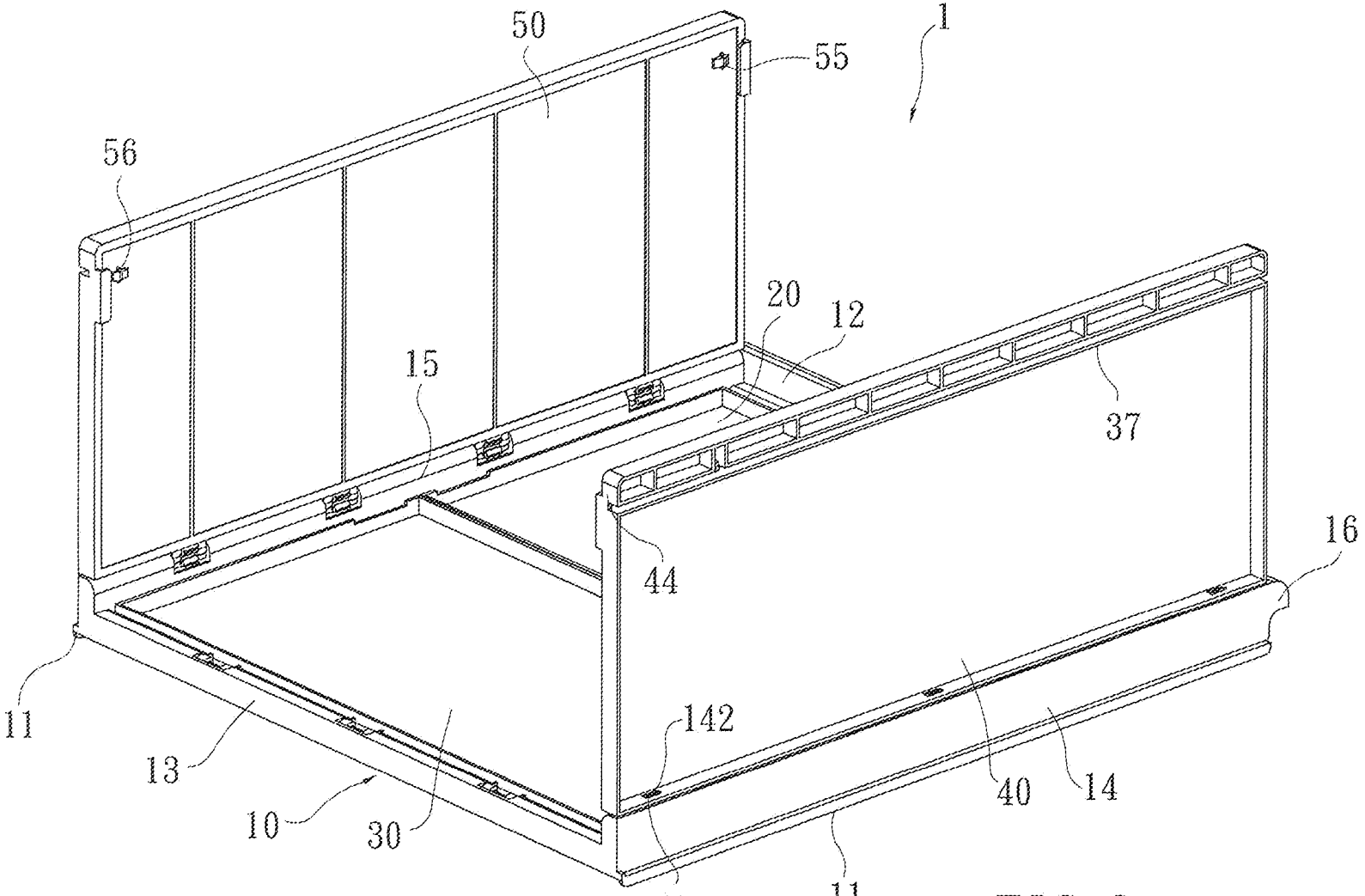

See FIGS. 5, 7, 8. The front and rear ends of the left panel 40 of the drawer 1 has one inward-facing protruding L-shaped hook 43, 44. The front and rear ends of the right panel 50 has one inward-facing protruding L-shaped hook 53, 54. When the front panel 20 is in upright position, the L-shaped hooks 43, 53 at the front ends of the left and right panels 40, 50 can stop at the front end of the front wall 20. When the rear panel 30 is in upright position, the L-shaped hooks 44, 54 at the rear ends of the left and right panels 40, 50 can stop at the rear end of the rear panel 30. The insides of the L-shaped hooks 43, 44, 53, 54 on the front and rear ends of the left and right panels 40, 50 each has one horizontally extending, double-slope inner stopping block 55, 56 (the figure does not show the inner stopping block on the left panel 40). The inner stopping blocks 55, 56 can each stop the insides of the front and rear panels 20, 30. This keeps the front and rear panels 20, 30 in upright position.

Figure 9:
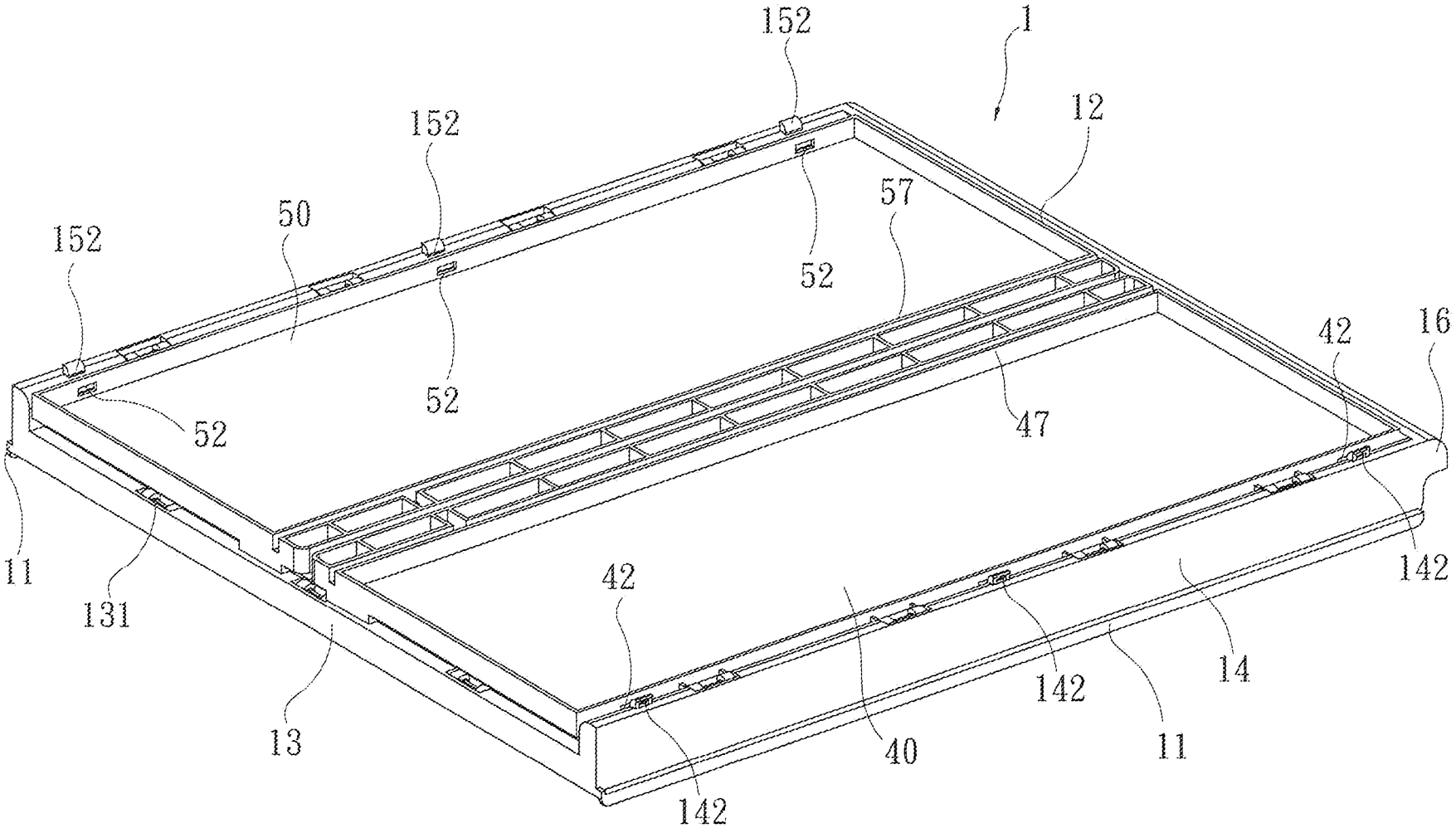

To fold the drawer 1, the front and rear panel 20, 30 rotates to lying position, as shown in FIGS. 7 and 8. Next, forcefully rotate the left and right panels 40, 50 into lying position to complete the folding of the drawer 1, as shown in FIG. 9.

Figure 10:
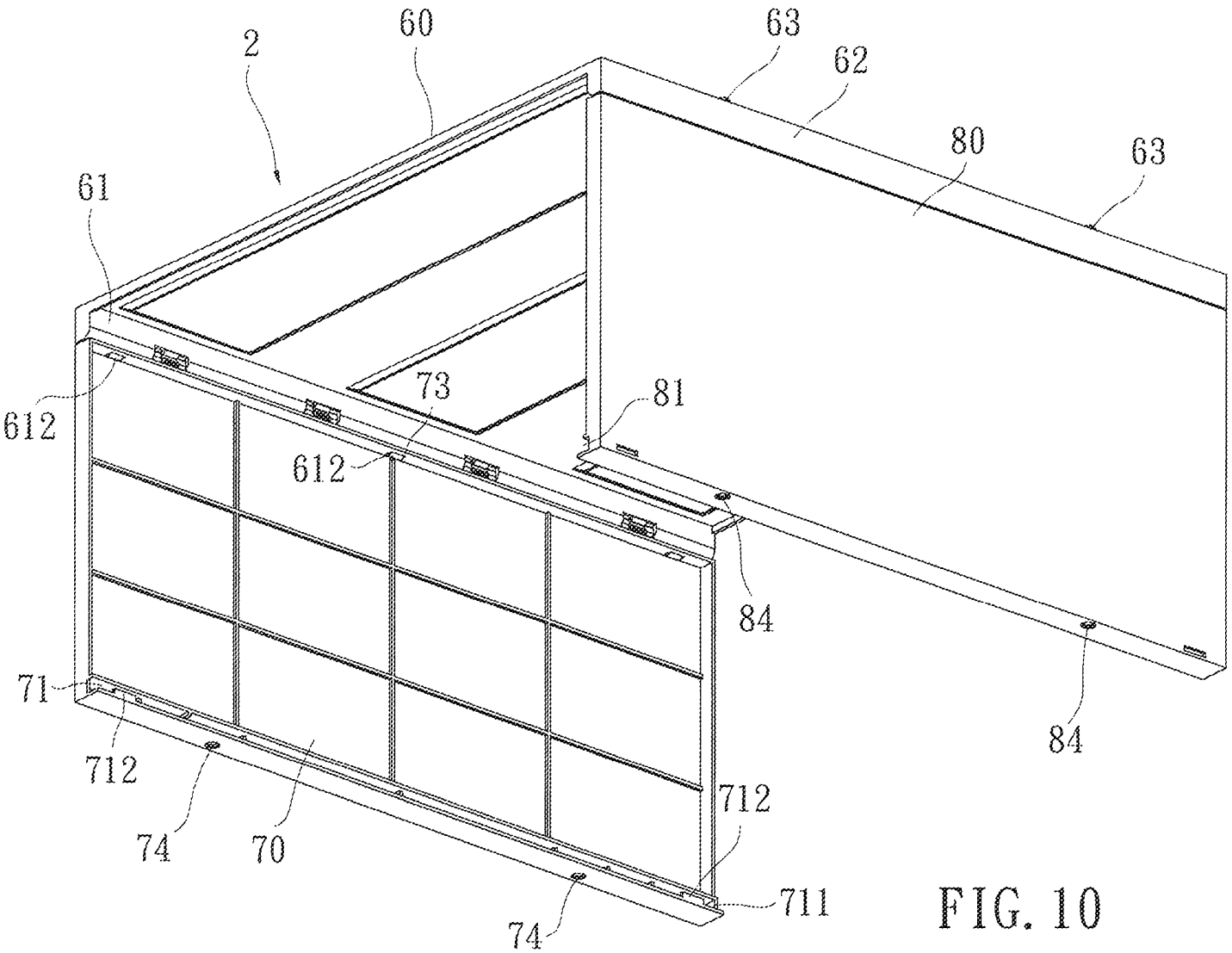
FIG. 10 is an exterior drawing of the shell.
Figure 11:
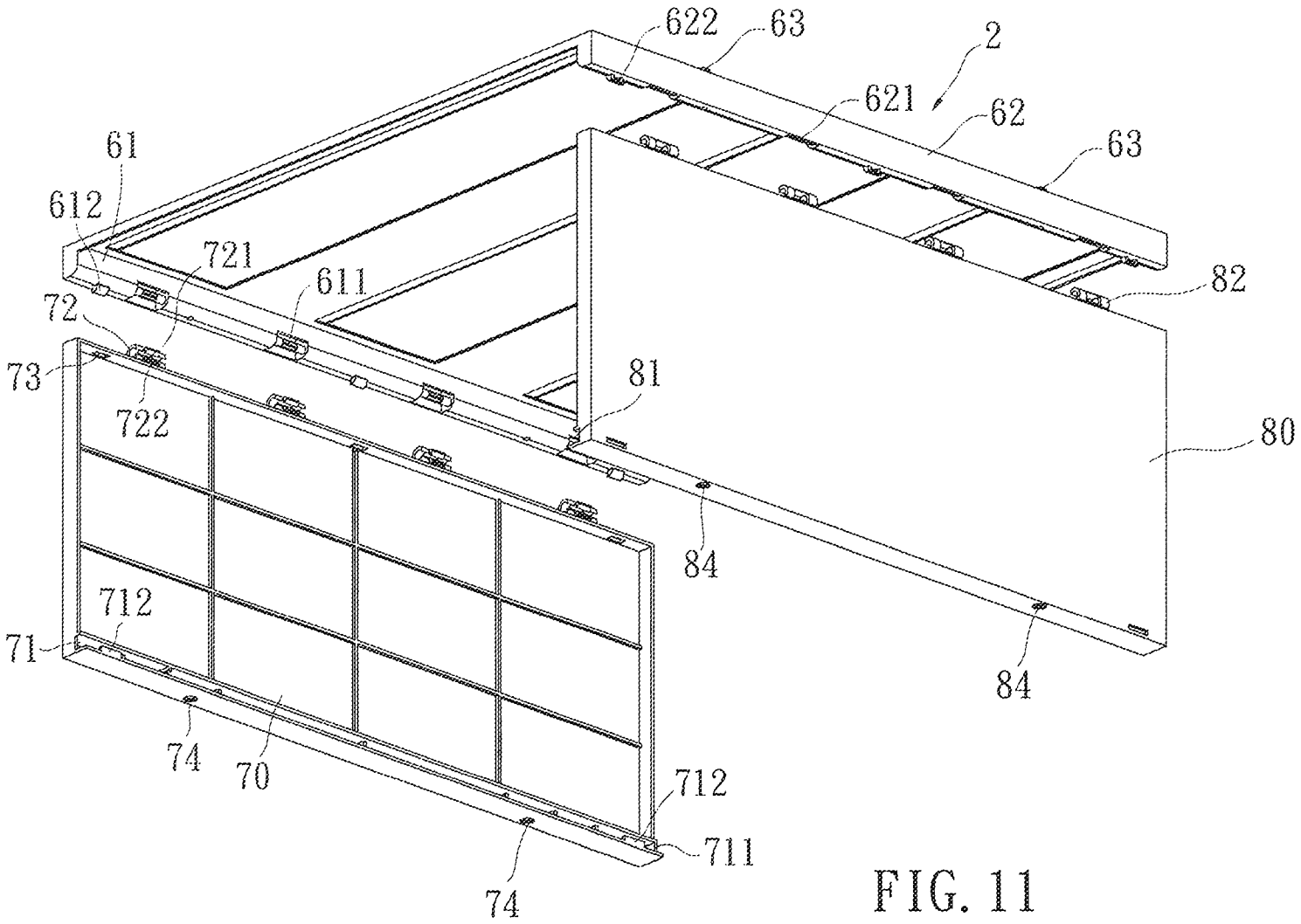
FIG. 11 is a breakdown drawing of the shell.

See FIGS. 10 and 11. The shell 2 consists of: one top panel 60, one left outer panel 70, and one right outer panel 80. The top ends of the left and right outer panels 70, 80 are each pin-connected to the left and right ends of the top panel 60. The left and right outer panels 70, 80 can then rotate to upright or lying position with the pin connections as axes. There is an inward-facing guiding groove 71, 81 on each of the insides of the left and right outer panels 70, 80. The guiding grooves 71, 81 each extends front-to-back. By inserting the two protruding bars 11 on the outer walls of the bottom panel 10 of the drawer 1 into the two guiding grooves 71, 81 of the insides of the left and right outer panels 70, 80 of the shell 2, the drawer 1 can be pushed into the shell 2. The two guiding grooves 71, 81 of the left and right outer panels 70, 80 of the shell 2 each has one stopping plate 711 (the figure does not show the stopping plate of the right outer panel 80). This prevents the drawer 1 to be pushed into the maximum depth of the shell 2. The two guiding grooves 71, 81 of the insides of the left and right outer panels 70, 80 of the shell 2 has at least one protruding plate 712, 812 on the bottom wall. The protruding plate 712 ensures the two protruding bars 11 on the bottom panel 10 of the drawer 1 to move in the corresponding guiding grooves 71, 81.

Each of the two sides of the top panel 60 of the shell 2 has a downward-facing protruding wall 61, 62. The inner walls of the two protruding walls 61, 62 each has at least one co-axial pivot 611, 621. The top ends of the left and right outer panels 70, 80 each has at least one C-shaped hook 72, 82 corresponding to each pivot 611, 621. By hooking the C-shaped hooks 72, 82 of the left and right outer panels 70, 80 onto the corresponding pivots 611, 621 of the top panel 60, the left and right outer panels 70, 80 can rotate to upright or lying position with the pivots 611, 621 as axes. In this embodiment, the two protruding bars 61 on the top panel 60 each has four pivots 611, 621. The left and right outer panels 70, 80 each has four C-shaped hooks 72, 82.

Figure 12:
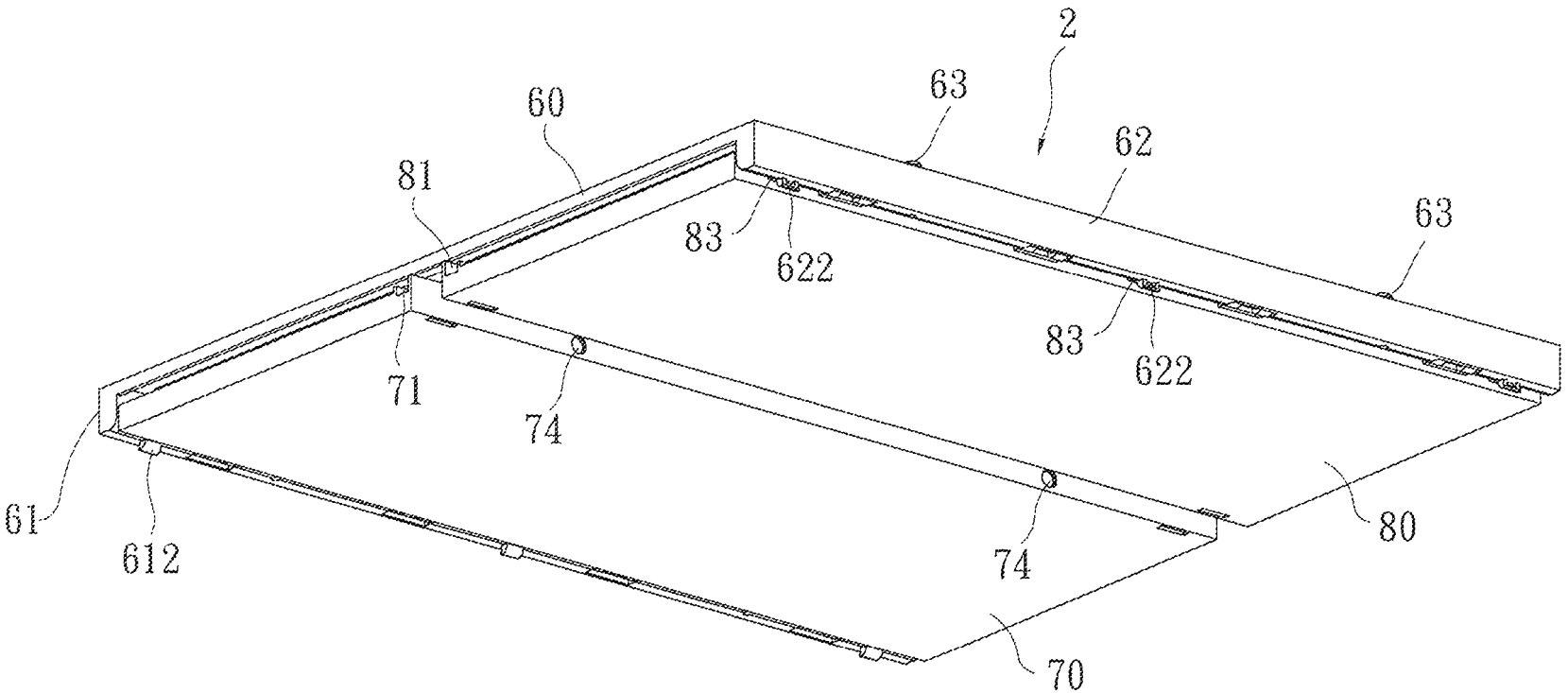
FIG. 12 is an exterior drawing of the shell folded flat.

The bottom ends of the two protruding walls 61, 62 of the top panel 60 of the shell 2 each has at least one downward-facing protruding hook 612, 622. The top ends of the left and right outer panels 70, 80 each has as least one hole 73, 83 (see FIG. 12) to allow the protruding hooks 612, 622 of the two protruding walls 61, 62 of the top panel 60 to pass through. This holds the left and right outer panels 70, 80 to be locked in upright position. The inside of each protruding hooks 612, 622 are in a curved shape, which allows the top ends of the left and right panels 70, 80 to cross the insides of the protruding hooks 612, 622. To fold the shell 2, forcefully rotate the front and rear outer panels 70, 80 to lying position to complete the folding of the shell 2, as shown in FIG. 12.

The aforementioned pivots 121, 131, 141, 151, 611, 612 share the same structure, and the C-shaped hooks 21, 31, 41, 51, 72, 82 share the same structure. Please see FIG. 11. Take the pivot 611 on the top panel 60 of the shell 2, and the C-shaped hook 72 of the left outer panel 70 as examples, the mid-section of the pivot 611 is in a cross shape. The corresponding opening of the C-shaped hook 72 has one upper and one lower spring plates 721, 722, which gives the opening of the mid-section of the C-shaped hook 72 a narrower width. By combining the spring plates 721, 722 of the C-shaped hook 72 with the mid-section of the pivot 611, the left outer plate can stay fixed in lying or upright position. The structure of the pivot 611 and C-shaped hook 72 is known technology, not a feature of this invention. Therefore, no further explanation is covered in this specification.

Figure 13:
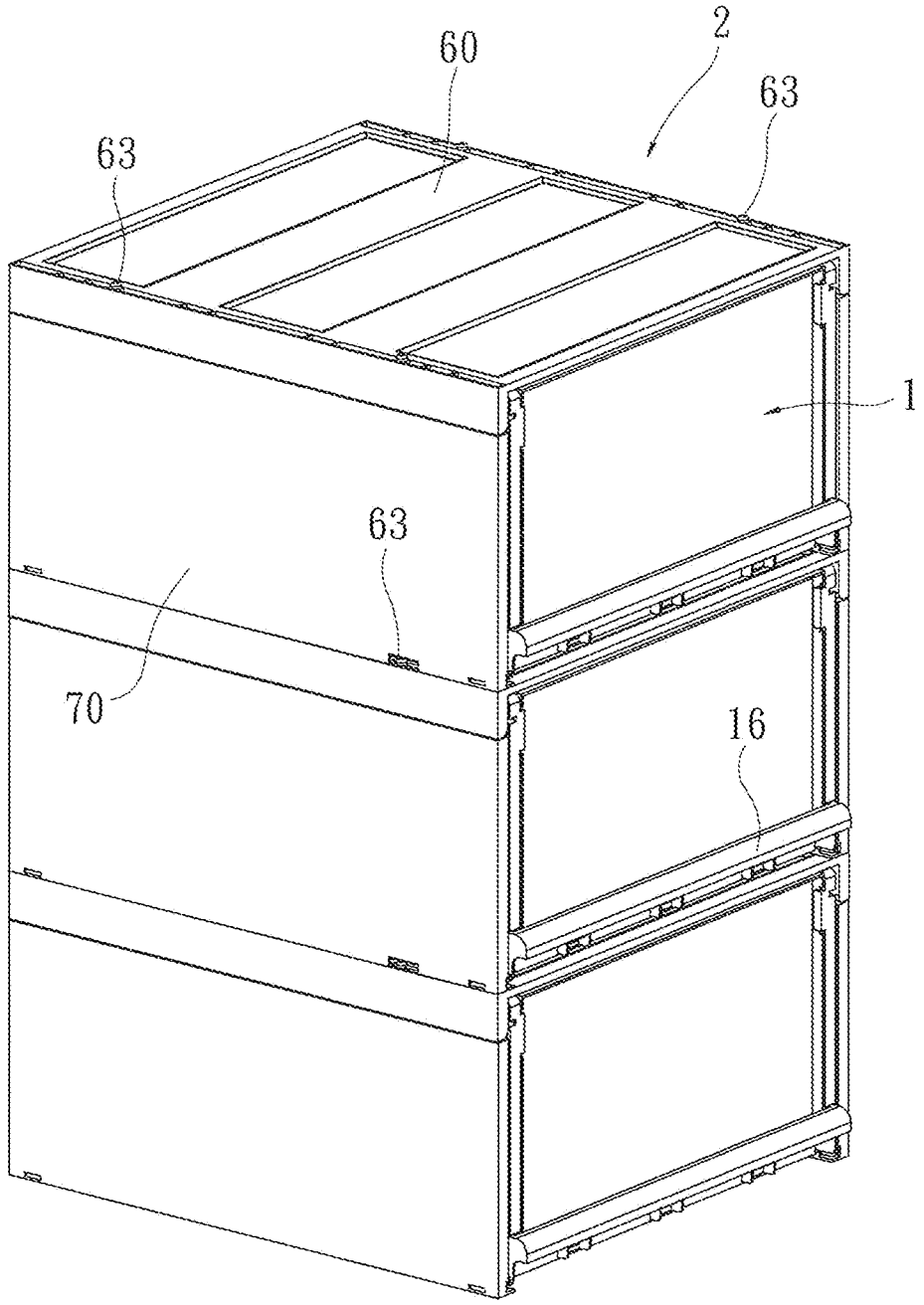
FIG. 13 demonstrates the devices stacked on one another.

The two edges of the top side of the top panel 60 of the shell 2 each has two protruding points 63. The bottom sides of the left and right outer panels 70, 80 each has two positioning holes 74, 84. The positioning holes 74, 84 and the protruding points 63 correspond to one another in a top-bottom manner. When in use, one of the shells 2 can be stacked on another. Thus, the protruding points 63 on top of the lower shell 2 can be inserted into the positioning holes 74, 84 of the upper shell 2. This allows the two shells to be stacked firmly, as shown in FIG. 13.

Figure 14:
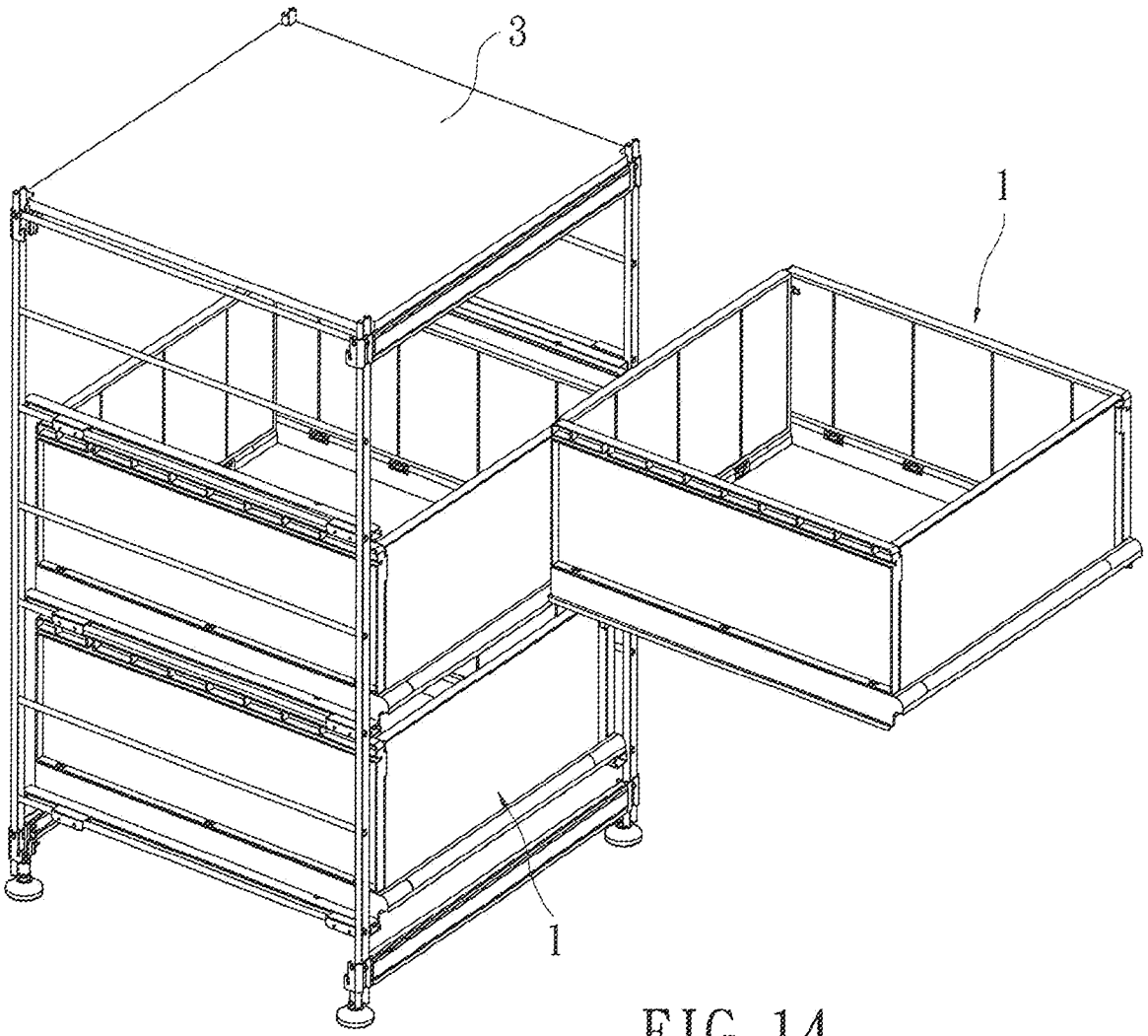
FIG. 14 demonstrates the drawers installed on an assembled shelf.
Figure 15:
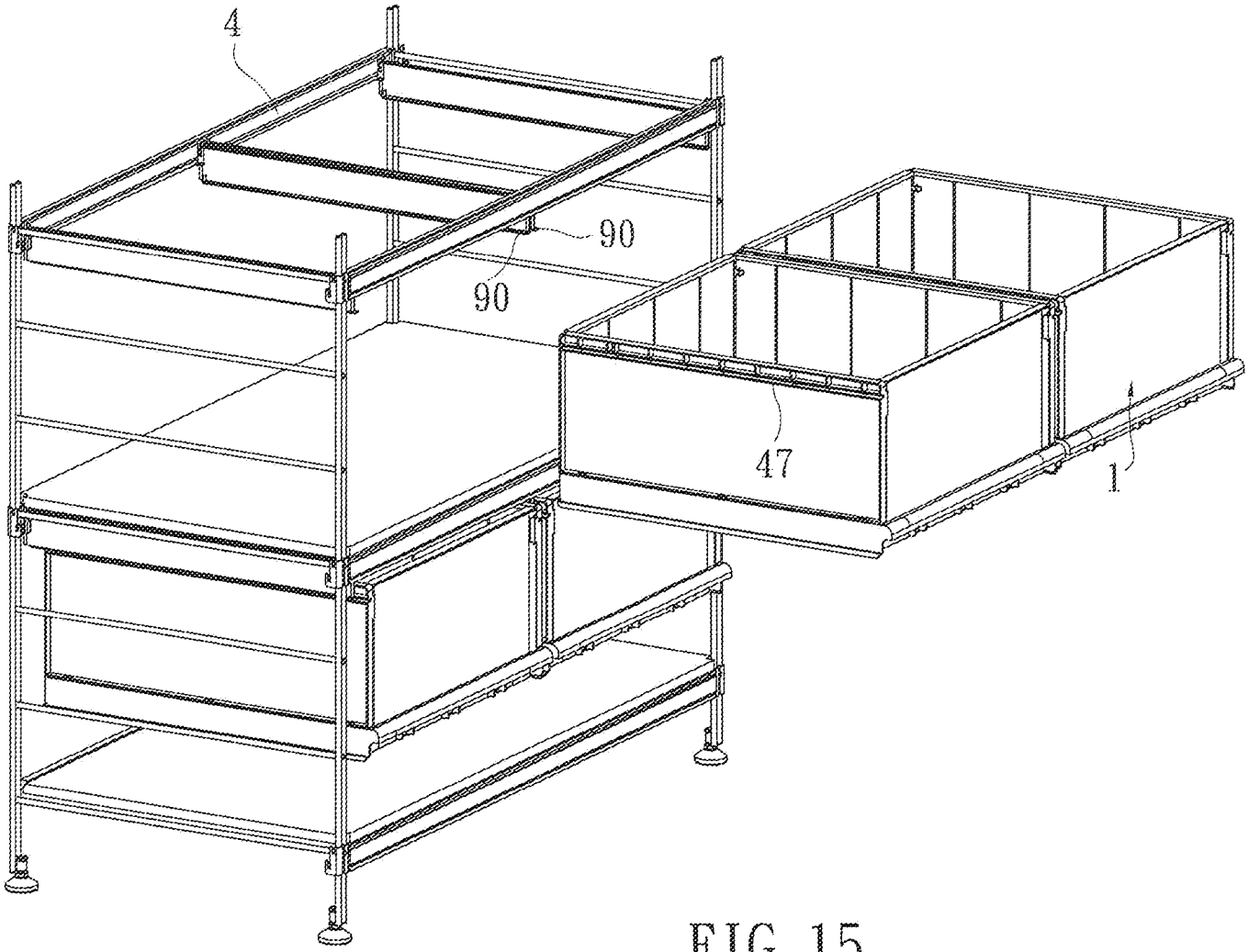
FIG. 15 demonstrates the drawers installed on a wider assembled shelf.

The drawer 1 can also be installed into an assembled shelf 3, as shown in FIG. 14. The outer walls of the left and right panels 40, 50 of the drawer 1 each has one groove 47, 57. The two grooves 47, 57 are at the same height and are placed with the back sides facing each other. The drawer 1 can be directly installed into another assembled shelf with a larger width 4, as shown in FIG. 14. The wider assembled shelf 4 has a rail 90 for the grooves 47, 57 of the left and rear panels 40, 50, allowing the drawer to move correctly.

In conclusion, the foldable drawer storage device disclosed in this invention can be folded flat to significantly reduce the size and help with storage and transportation. The drawer alone can also be installed into assembled shelves, which adds to the storage capabilities of such assembled shelved.

What is claimed is:

1. A foldable drawer storage device, which consists of:

one drawer, including: one bottom panel, one front panel, one rear panel, one left panel, and one right panel, wherein lower ends of the front, rear, left and right panels include pin-connections to front, rear, left and right ends of the bottom panel, wherein the front, rear, left, and right panels can each rotate to upright and lying positions with the pin connections as axes, wherein two outer walls of the bottom panel each has a protruding bar with back sides facing each other, and wherein the protruding bars each extends front-to-back; and one shell, including: one top panel, one left outer panel, and one right outer panel, wherein top ends of the left and right outer panels are each pin-connected by pivots to left and right ends of the top panel, the left and right outer panels can each rotate to upright and lying positions with the pivots as axes, and an inward-facing guiding groove is positioned on inside of each of the left and right outer panels extending front-to-back, and wherein the drawer is pushed into the shell by inserting the two protruding bars on the outer walls of the bottom panel of the drawer into the two guiding grooves of the insides of the left and right outer panels of the shell;

wherein each of the left and right ends of the top panel of the shell has a downward-facing protruding wall, inner walls of the two downward-facing protruding walls each has at least one said pivot, the top ends of the left and right outer panels each has at least one C-shaped hook corresponding to each said pivot, the left and right outer panels rotate to the upright and lying positions with the pivots as axes by hooking the C-shaped hooks of the left and right outer panels onto the pivots of the top panel, bottom ends of the two downward-facing protruding walls of the top panel each has at least one downward-facing protruding hook, and the top ends of the left and right outer panels each has at least one hole to allow the downward-facing protruding hooks of the two downward-facing protruding walls of the top panel to pass through for holding the left and right outer panels in the upright position.

2. A foldable drawer storage device, which consists of:

one drawer, including: one bottom panel, one front panel, one rear panel, one left panel, and one right panel, wherein lower ends of the front, rear, left and right panels include pin-connections to front, rear, left and right ends of the bottom panel, wherein the front, rear, left, and right panels can each rotate to upright and lying positions with the pin connections as axes, wherein two outer walls of the bottom panel each has a protruding bar with back sides facing each other, and wherein the protruding bars each extends front-to-back; and one shell, including: one top panel, one left outer panel, and one right outer panel, wherein top ends of the left and right outer panels are each pin-connected by pivots to left and right ends of the top panel, the left and right outer panels can each rotate to upright and lying positions with the pivots as axes, and an inward-facing guiding groove is positioned on inside of each of the left and right outer panels extending front-to-back, and wherein the drawer is pushed into the shell by inserting the two protruding bars on the outer walls of the bottom panel of the drawer into the two guiding grooves of the insides of the left and right outer panels of the shell;

wherein each of the front, rear, left, and right ends of the bottom panel of the drawer has an upward-facing protruding wall, inner walls of the upward-facing protruding walls each has at least one co-axial pivot, the lower ends of the front, rear, left and right panels each has at least one C-shaped hook corresponding to each said pivot on the protruding walls, the front, rear, left and right panels rotate with the pivots as axes by hooking the C-shaped hooks of the front, rear, left and right panels onto the pivots of the bottom panel, top ends of the left and right protruding walls of the bottom panel of the drawer each has at least one upward-facing protruding hook, and the lower ends of the left and right panels each has at least one hole for the protruding hooks of the left and right protruding walls of the bottom panel to pass through for holding the left and right panels to be locked in the upright position.

3. A foldable drawer storage device, which consists of:

one drawer, including: one bottom panel, one front panel, one rear panel, one left panel, and one right panel, wherein lower ends of the front, rear, left and right panels include pin-connections to front, rear, left and right ends of the bottom panel, wherein the front, rear, left, and right panels can each rotate to upright and lying positions with the pin connections as axes, wherein two outer walls of the bottom panel each has a protruding bar with back sides facing each other, and wherein the protruding bars each extends front-to-back; and one shell, including: one top panel, one left outer panel, and one right outer panel, wherein top ends of the left and right outer panels are each pin-connected by pivots to left and right ends of the top panel, the left and right outer panels can each rotate to upright and lying positions with the pivots as axes, and an inward-facing guiding groove is positioned on inside of each of the left and right outer panels extending front-to-back, and wherein the drawer is pushed into the shell by inserting the two protruding bars on the outer walls of the bottom panel of the drawer into the two guiding grooves of the insides of the left and right outer panels of the shell;

wherein front and rear ends of the left panel of the drawer has one inward-facing protruding L-shaped hook, front and rear ends of the right panel of the drawer has one inward-facing protruding L-shaped hook, the L-shaped hooks at the front ends of the left and right panels stop at a front end of the front wall when the front panel is in the upright position, the L-shaped hooks at a rear ends of the left and right panels stop at the rear end of the rear panel when the rear panel is in the upright position, and insides of the L-shaped hooks on the front and rear ends of the left and right panels each has one horizontally extending, double-slope inner stopping block stopping, insides of the front and rear panels.

* * * * *